US008425244B2

(12) United States Patent
Bayliss et al.

(10) Patent No.: US 8,425,244 B2
(45) Date of Patent: Apr. 23, 2013

(54) CONNECTOR WITH A LOCKING SLEEVE FOR LOCKING TO A SOCKET HAVING A CIRCULAR BAND

(75) Inventors: Christopher J. Bayliss, Chicago, IL (US); Andy A. Hoang, Lake in the Hills, IL (US); Armando R. Zacarias, Port Barrington, IL (US)

(73) Assignee: Motorola Solutions, Inc., Schaumburg, IL (US)

( * ) Notice: Subject to any disclaimer, the term of this patent is extended or adjusted under 35 U.S.C. 154(b) by 0 days.

(21) Appl. No.: 13/191,165

(22) Filed: Jul. 26, 2011

(65) Prior Publication Data

US 2013/0029510 A1 Jan. 31, 2013

(51) Int. Cl.
*H01R 13/62* (2006.01)

(52) U.S. Cl.
USPC ..... 439/320

(58) Field of Classification Search ..... 439/318, 439/320, 310–314
See application file for complete search history.

(56) References Cited

U.S. PATENT DOCUMENTS

| | | | | |
|---|---|---|---|---|
| 4,486,062 | A * | 12/1984 | Kasugai | 439/345 |
| 4,776,813 | A * | 10/1988 | Wilson et al. | 439/587 |
| 5,058,649 | A | 10/1991 | Hoang et al. | |
| 5,618,204 | A * | 4/1997 | Nix et al. | 439/559 |
| 6,682,360 | B2 * | 1/2004 | Schauer et al. | 439/323 |
| 6,737,592 | B1 | 5/2004 | Hoang et al. | |
| 6,793,537 | B2 | 9/2004 | Stefaniu et al. | |
| 6,994,579 | B2 * | 2/2006 | Yokoigawa et al. | 439/320 |
| 7,048,578 | B2 * | 5/2006 | Rodrigues | 439/578 |
| 7,077,677 | B2 * | 7/2006 | Sanuki | 439/318 |
| 7,175,459 | B2 * | 2/2007 | Milner et al. | 439/271 |
| 7,198,516 | B1 | 4/2007 | Kemelman et al. | |
| 7,259,357 | B2 | 8/2007 | Walker | |
| 7,303,418 | B2 * | 12/2007 | O'Connor | 439/277 |
| 7,381,078 | B2 * | 6/2008 | Mtchedlishvili et al. | 439/352 |
| 7,484,981 | B2 | 2/2009 | Garcia et al. | |
| 7,628,545 | B2 * | 12/2009 | Cody et al. | 385/69 |
| 7,722,379 | B2 * | 5/2010 | Yang et al. | 439/352 |
| 7,972,154 | B2 * | 7/2011 | Pech et al. | 439/173 |
| 2006/0099838 | A1 * | 5/2006 | Meyers | 439/134 |
| 2006/0154522 | A1 | 7/2006 | Bernhart et al. | |
| 2007/0268687 | A1 | 11/2007 | Scannell, Jr. | |
| 2009/0142952 | A1 * | 6/2009 | Akasaka | 439/314 |
| 2009/0191752 | A1 * | 7/2009 | Montena | 439/584 |
| 2010/0021059 | A1 | 1/2010 | Ito | |
| 2011/0017491 | A1 | 1/2011 | Lu et al. | |
| 2011/0065308 | A1 | 3/2011 | Lu et al. | |

* cited by examiner

*Primary Examiner* — Chandrika Prasad
(74) *Attorney, Agent, or Firm* — Barbara R. Doutre

(57) ABSTRACT

A locking mechanism for a connector (100) facilitates the interconnect between the connector and an electronic device (200). The connector (100) is formed of a plug (102), a locking sleeve (104) and an o-ring (112). The locking sleeve has a locking pattern (108) that, upon rotation of the locking sleeve, engages and disengages lock between the plug and a socket within the electronic device. Friction from the o-ring (112) on the locking sleeve (104) prevents disengagement of the connector from the electronic device while providing a seal.

21 Claims, 9 Drawing Sheets

CONNECTOR WITH A LOCKING SLEEVE FOR LOCKING TO A SOCKET HAVING A CIRCULAR BAND

FIELD OF THE INVENTION

The present invention relates generally to connectors and more particularly to a connector for an electronic device.

BACKGROUND

In today's communication systems, accessories are often utilized to provide a user with remote access to certain key features associated with another electronic device. Examples of such accessories include, but are not limited to, remote speaker microphones, displays, earpiece devices, and headsets to name a few. Accessory connectors are typically used to interconnect the accessory to the electronic device. Several design challenges are associated with the implementation of an accessory connector, particularly when such a connector may be handled under adverse conditions, such as those conditions potentially encountered within the public safety arena involving law enforcement, fire rescue or emergency medical.

The design challenges associated with connector assemblies, in particular those involving an audio plug, include the amount of force needed to connect and disconnect the plug from an accessory jack. High variations in the jack's retention force may cause breakage if too tight or accidental detachment if too loose. The manner in which the plug is supported within the accessory jack may also leave the plug vulnerable to side pull and torque forces. The connector assembly may be subjected to a variety of rugged environments, particularly when operating in the public safety arena. For example, gloved users have a more difficult time sensing tactile feedback as the accessory is connected and disconnected. Sealing of the accessory connector is another concern as accessory devices used in the public safety arena are subjected to a variety of environmental conditions, such as water and dust. Spring probe connectors, for example, are typically vulnerable to dust and other contaminants. Circular connectors, for example, tend to be too large for portable type accessories. Existing audio plug and jack connectors have issues with both sealing and locking. Size, cost and ease of manufacturing are also taken into consideration, particularly for accessories which are worn or carried by a user.

Hence, a connector having an improved connector interface is highly desirable.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
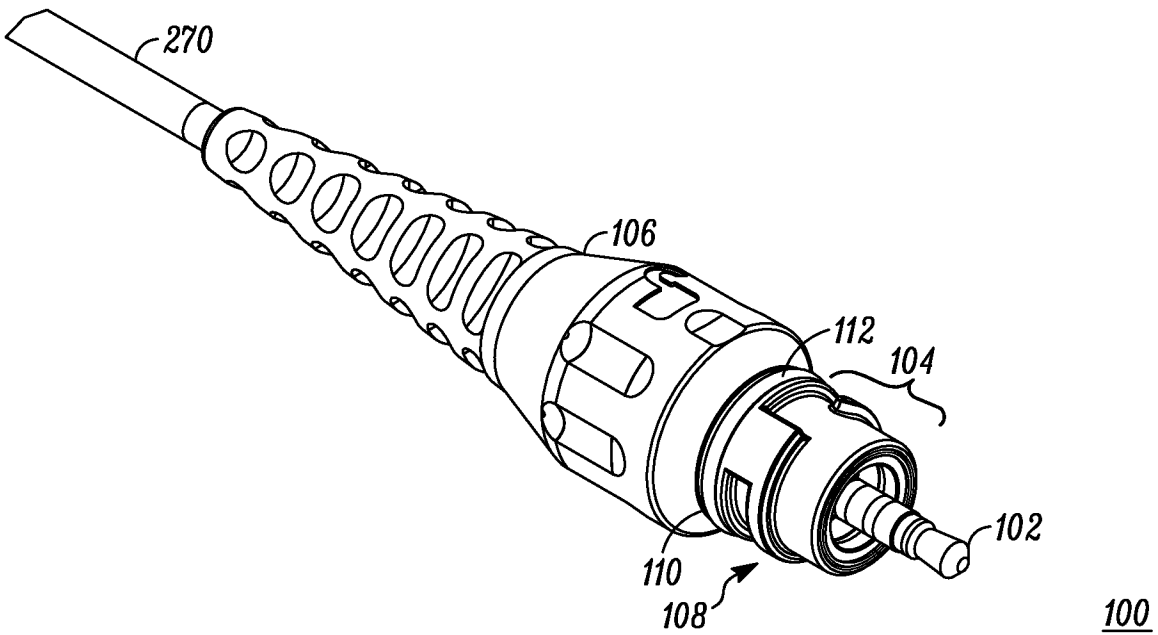
FIG. 1 is an isometric view of a connector having a locking sleeve in accordance with various embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in apparatus components related to a connector. An improved interface is provided via a locking mechanism which facilitates engagement and disengagement of the connector to an electronic device. The connector to be described herein facilitates the management of electronic accessories and devices, particularly those used in mission critical applications where many devices need to be easily accessed by a user. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the elements.

FIG. 1 is an isometric view of a connector 100 in accordance with the various embodiments. Connector 100 comprises an audio plug 102, a locking sleeve 104 and a strain relief 106. Locking sleeve 104 provides an improved locking mechanism used to interface the connector 100 to an electronic device. In accordance with the various embodiments, the locking sleeve 104 provides a locking pattern 108 integrated thereon. The locking sleeve 104 further comprises a recess 110 within which to retain an o-ring 112 for locking and sealing. For the purposes of this application, the connector 100 provides a male, plug type connector which couples to a female, socket type receptacle of an electronic device. While referred to as an audio plug within the examples and embodiments described herein, the plug may any circular off-the shelf component having electrical contacts which may rotate up to 360 degrees.

Figure 2C:
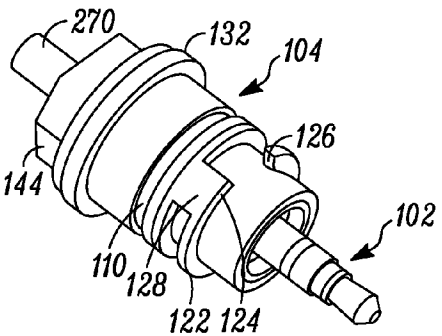
FIGS. 2A-2E show the various components of the connector of FIG. 1 in various sub-assembly stages in accordance with the various embodiments.
Figure 2E:
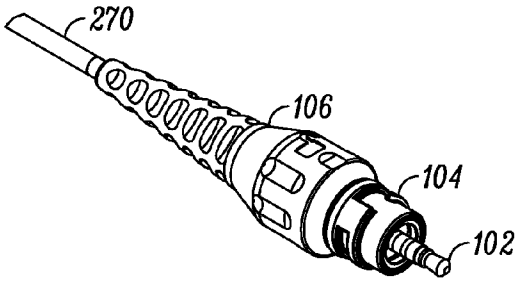
Figure 2B:
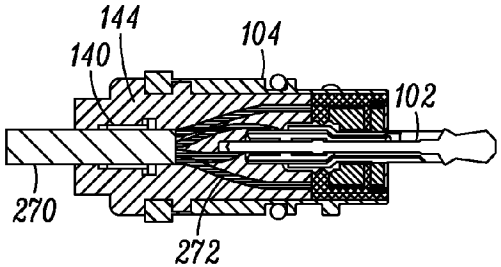
Figure 2D:
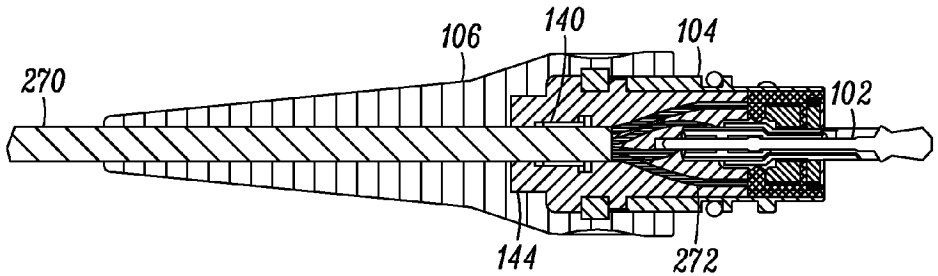
Figure 2A:
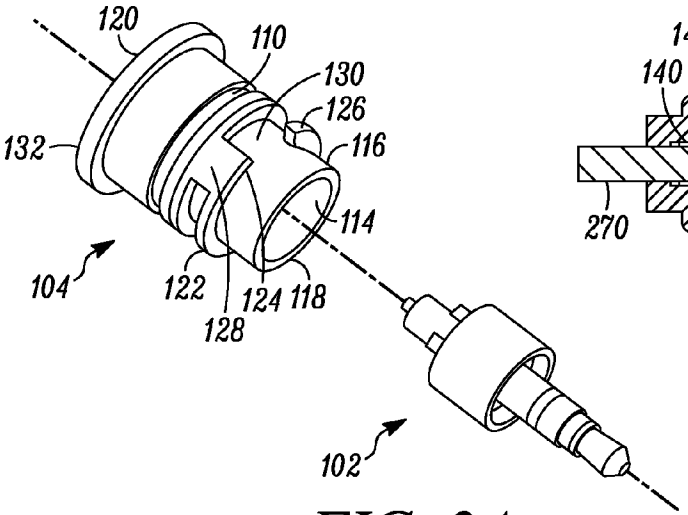

FIGS. 2A-2E show the various components of connector 100 in accordance with various assembly stages. FIG. 2A shows the audio plug 102 and locking sleeve 104. Again, audio plug 102 can be any circular off-the shelf component having electrical contacts which may rotate up to 360 degrees. Examples of such plugs, include but are not limited to, audio plugs and plugs used in lighting, display and data applications. The locking sleeve 104 is formed of a unitarily molded cylindrical piece fabricated of polymer, glass filled polymer, thermoplastic elastomer or metallic type of material(s) or the like.

In accordance with the various embodiments, locking sleeve 104 provides a hollow body having an inner surface 114 and an outer surface 116, and first and second openings 118, 120 at either end. The locking pattern 108 of locking sleeve 104 is formed of a circular band 122 on the outer surface 116 having first and second ends 124, 126, and a locking tab 128 formed at the first end 124. A gap 130 is formed between the locking tab 128 and the second end 126 of the circular band 122. The locking sleeve 104 further comprises a collar 132 integrated on the outer surface 116 at the second opening 120. The recess 110 for retaining the o-ring 112 is formed between the collar 132 and the circular band 122. Thus, the collar 132 is located adjacent to the recessed o-ring, and the recessed o-ring 112 is located adjacent to the locking pattern. The locking sleeve 104 provides sealing and locking via the locking pattern 108 and recessed o-ring 112. The locking pattern 108 provides a predetermined range of rotation less than 360 degrees thereby preventing over rotation of the connector 100.

FIG. 2B shows a cross sectional sub-assembly view of the audio plug 102 inserted within the locking sleeve 104. Wires 272 are connected to plug 102 in any electrically conductive manner that provides signal transmission. Crimp 140 is clamped to a cable jacket 270 for mechanical retention between the cable and a pre-mold 144. Crimp 140 can be any off-the shelf piece part which can provide mechanical retention features. Once the plug 102, cable 270, and crimp 140 are positioned within the locking sleeve 104, a pre-mold 144 is applied. Pre-mold 144 is formed to the inner surface 114 and back surface having collar 132 of locking sleeve 104 as well as around cable 270, crimp 140, wires 272, and the back surface of plug 102. The wires 272 coupled to the plug 102 as well as the interlaced pre-mold material bond prevent the plug from being pulled out of the front of the locking sleeve 104.

FIG. 2C shows an isometric view of the audio plug 102 inserted within locking sleeve 104 along with pre-mold 144 formed within the locking sleeve 104. At this stage, the sub-assembly of FIG. 2C is ready to be over-molded to form strain relief 106.

FIG. 2D shows cross sectional view of the connector 100 in which the over-molded strain relief 106 is coupled over pre-mold 144 and a portion of the locking sleeve 104. As seen in FIG. 2E, the over-molded strain relief 106 is formed and applied to the locking sleeve 104, such that the locking mechanism, including the locking pattern 108 and the recess 110 (for receiving o-ring 112), remains exposed. Collar 132 is completely encased within the over-molded strain relief 106 and is not visible. Collar 132 provides mechanical retention between locking sleeve 104 and over-molded strain relief 106.

The components shown in FIGS. 2A-2E are assembled by inserting the audio plug 102 into the locking sleeve 104, connecting wires 272 connected to plug 102 in any electrically conductive manner that provides signal transmission. Crimp 140 is applied on to cable 270. The pre-mold 144 is applied inside of locking sleeve 104. The over-molded strain relieve 106 is then applied over the pre-mold 144 and locking sleeve 104.

Figure 4:
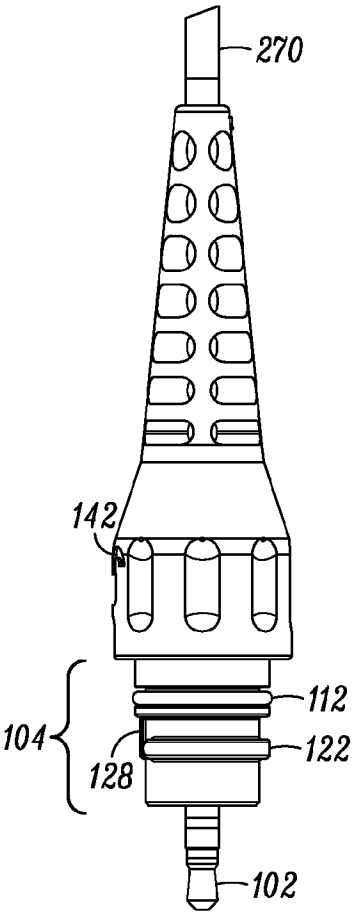
FIG. 4 shows a second side view of the connector in accordance with the various embodiments.
Figure 3:
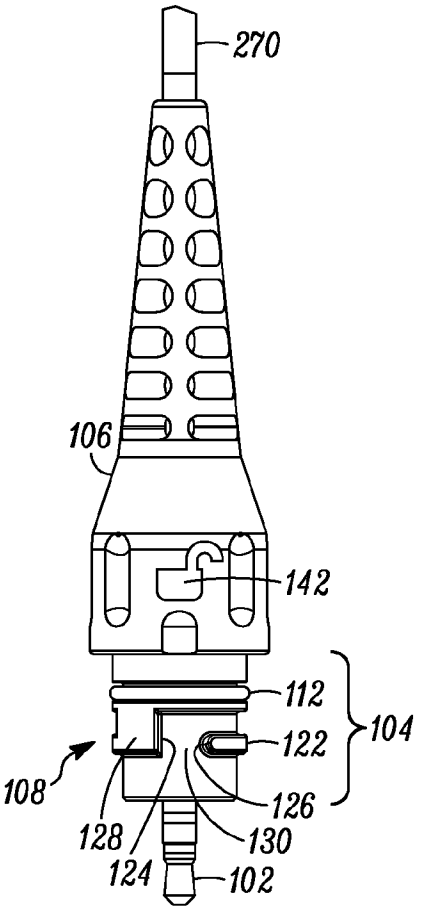
FIG. 3 shows a first side view of the connector in accordance with the various embodiments.

FIGS. 3 and 4, show first and second side views of connector 100 in accordance with the various embodiments. These views show the locking sleeve 104 having the locking pattern 108 for locking to a corresponding geometry within the housing of an electronic device. In accordance with the various embodiments, locking pattern 108 is exposed and formed of circular band 122 having gap 130 between first and second ends, 124, 126, with the locking tab 128 being formed at one end. The locking pattern 108 further comprises recess 110 within which the o-ring 112 is retained.

As seen in FIG. 3, a marking or symbol 142, for example an unlock icon, may be labeled on the strain relieve 106 to facilitate alignment of the connector 100 into an electronic device. FIG. 4 shows a quarter turn of the connector 100 which shows the circular band 122 and an edge of the locking tab 128.

Figure 6:
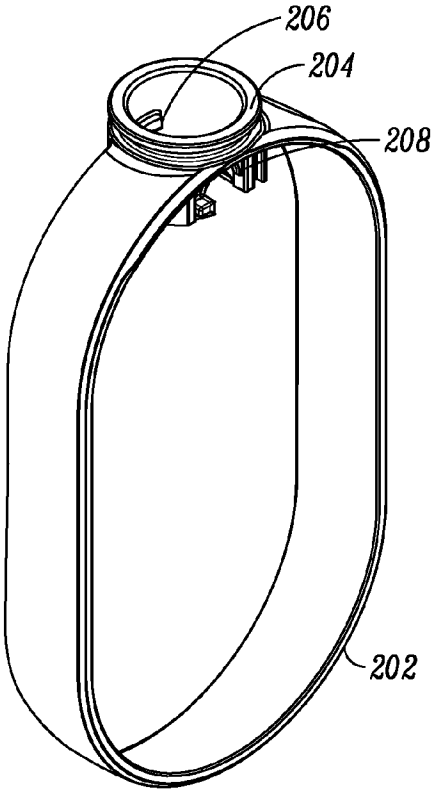
FIG. 6 shows a second inside view of the electronic device in accordance with the various embodiments.
Figure 5:
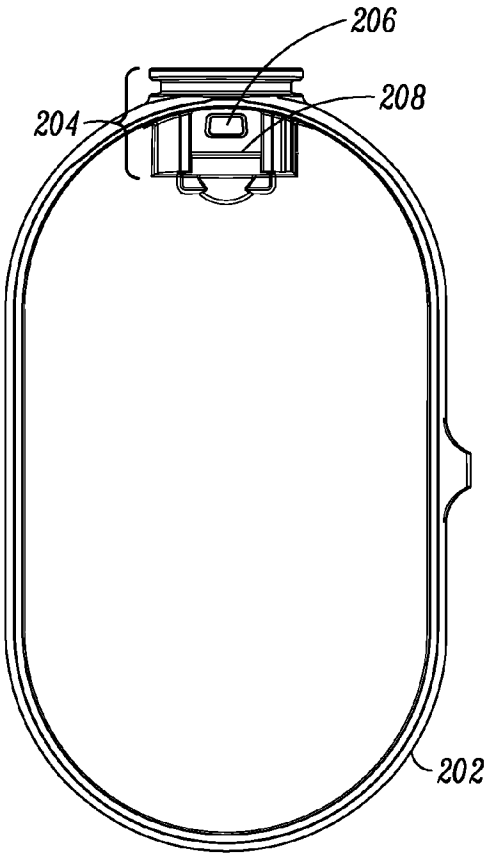
FIG. 5 shows a first inside view of an electronic device having a socket for receiving the connector in accordance with the various embodiments.

FIGS. 5 and 6 show first and second cut-away views of a housing 202 for an electronic device having a socket 204 for receiving the connector 100 in accordance with the various embodiments. Socket 204 includes a first hard-stop 206 integrally formed therein as a tab. The first hard-stop 206 prevents partial disengagement once the connector is locked and prevents over rotation of the connector 100 within the socket 204. A second hard-stop 208 is also integrally formed towards the base of the socket, shown in the form of a partial circular collar. The second hard-stop 208 prevents over insertion of the connector 100 within the socket 204.

Figure 7B:
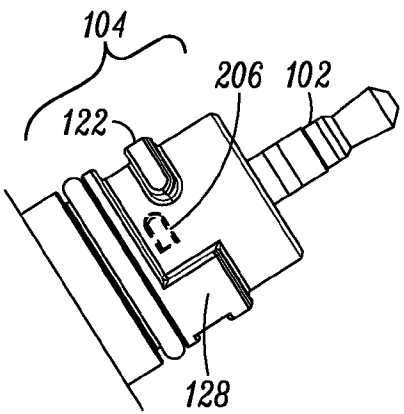
FIG. 7B is a break-away view of FIG. 7A showing the locking sleeve of the connector and a hard-stop of the electronic device in accordance with the various embodiments.
Figure 7A:
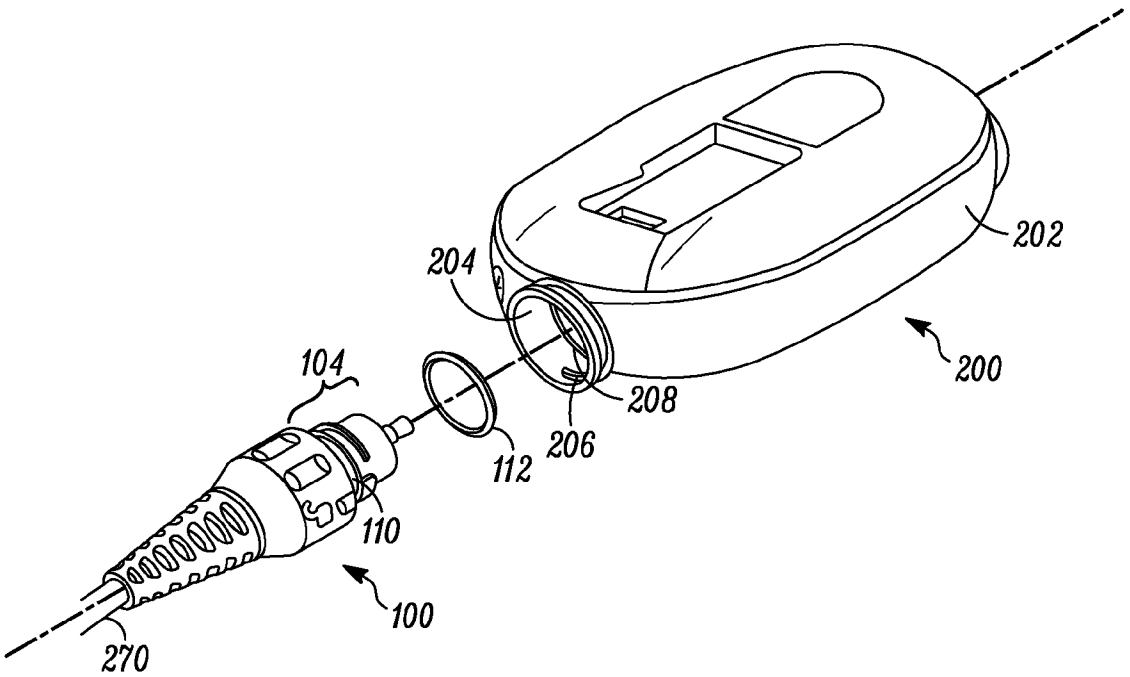
FIG. 7A shows the connector aligned for insertion into the electronic device in accordance with the various embodiments.

FIG. 7A is a partially exploded view of the connector 100 and electronic device 200 in accordance with the various embodiments. Connector 100 is formed, as previously described, of audio plug 102, locking sleeve 104 and strain relief 106. Connector 100 receives o-ring 112 into recess 110. Electronic device 200 includes socket 204 of housing 202 and jack 220 (such as audio jack 220 shown in FIG. 9) for receiving connector 100.

FIG. 7A shows the first hard-stop 206 formed on an interior surface of the socket 204. The first hard-stop 206, in conjunction with the locking pattern of the locking sleeve 104, prevents rotation beyond a predetermined angle of rotation set to any angle less than 360 degrees. The second hard-stop 208 is also formed on an interior surface of the socket 204. The second hard-stop 208 within the socket 204 prevents over insertion. Thus, first hard-stop 206 prevents rotation, and second hard-stop 208 prevents over-insertion.

The plug 102 of connector 100 is initially inserted within the jack 220, but full entry of the plug will be prevented as the circular band 122 of the locking sleeve 104 will hit first hard-stop 206 upon insertion, until the connector 100 is rotated such that the gap 130 of locking sleeve 104 aligns with the first hard-stop 206. This point of engagement, shown in FIG. 7B, also corresponds to the symbol 142 of connector 100 aligning with the symbol 242 of the electronic device. Once connector 100 is fully inserted into socket 204, further rotation of connector 100 until locking tab 128 hits first hard-stop 206, will lock the connector at a predetermined point of rotation, for example a three quarter turn or 270 degrees of rotation. Friction from the o-ring 112 on the locking sleeve 104 further prevents disengagement of the lock while providing a seal. This engagement strategy is very useful when a user is coupling devices in visually challenged environment, such as smoky environment, where the user may be unable to view the alignment symbols. This improved interface facilitates user awareness of the locked and fully inserted connector position as first hard-stop 206 prevents further rotation.

Once engaged, further rotation of the connector 100 rotates circular band 122 while first hard-stop 206 is retained between the band and the recess for the o-ring 112. Only upon rotating back to gap 130 can the connector be disengaged. As with the engagement process, the user is able to disengage the connector 100 without having to visually see the symbols on the two devices. Reversing rotation until the locking tab 128 hits the first hard-stop 206 in the opposing direction allows the gap 130 of connector 100 to slide past first hard-stop 206 of socket 204 thereby disconnecting the connector 100 from the electronic device 200.

Figure 8:
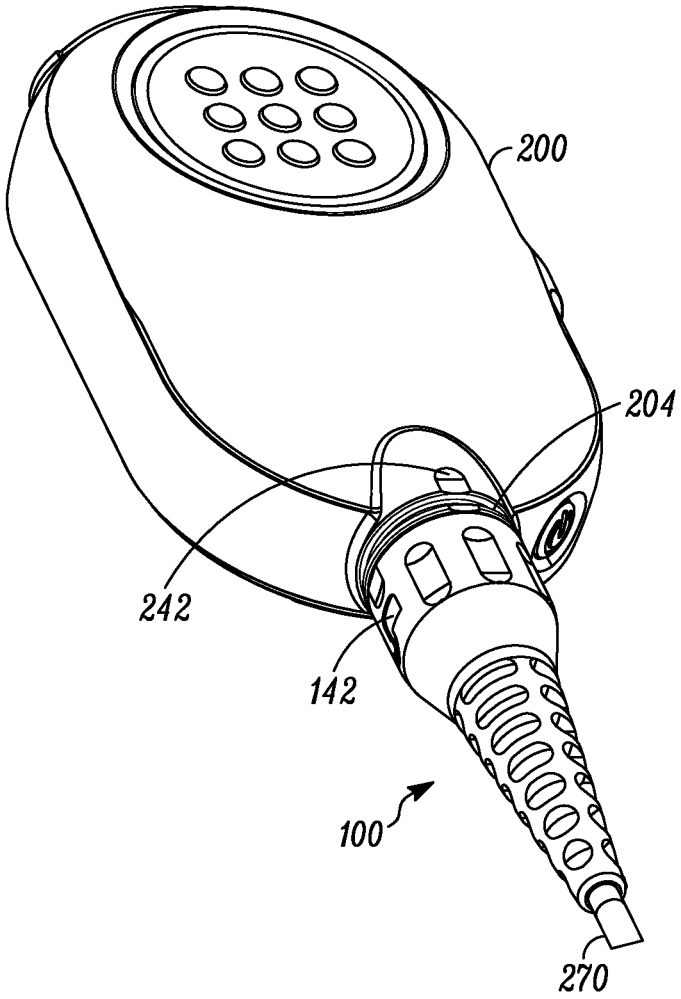
FIG. 8 shows the connector locked into the electronic device of FIG. 7A in accordance with the various embodiments.

FIG. 8 shows connector 100 formed in accordance with the various embodiments coupled and locked into housing socket 204 thereby securing and protecting the connection to electronic device 200. The locking sleeve 104 has been rotated such that the marking symbol 142 has been rotated past symbol 242 on the housing 202. The connector 100 remains locked throughout further rotation of the strain relief 106 thereby preventing detachment from the jack 220 and housing socket 204. Once engaged, further rotation of the connector 100 rotates circular band 122 while first hard-stop 206 is aligned between the band and the recess for the o-ring 112. Again, over rotation is prevented by locking tab 128 of locking pattern 108 the first hitting hard-stop 206 in a first direction. Only upon rotating back to gap 130 where the locking tab 128 hits the first hard-stop 206 in a second direction, can the connector be disengaged.

Figure 9:
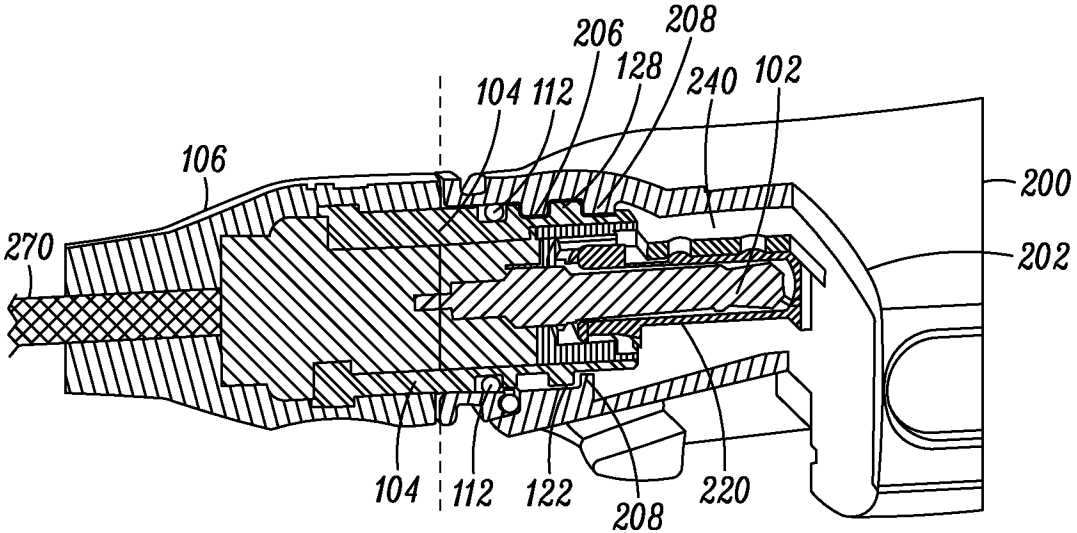
FIG. 9 shows a cross sectional view of the connector locked within the electronic device in accordance with the various embodiments.

FIG. 9 shows a cross section view of the connector 100 coupled within electronic device 200. This view shows connector 100 coupled to the audio jack 220 and socket 204 of housing 202. In accordance with the various embodiments, the connector 100 is insertably coupled to the socket 204 via locking sleeve 104 and the o-ring 112 such that a predetermined turn of the locking sleeve engages lock between the audio plug and the housing 202. Friction from the o-ring 112 on the locking sleeve 104 and socket 204 prevents disengagement of lock. This view shows electronic device 200 closing off the recess 110 within which o-ring 112 is seated thereby sealing the interconnection between the connector 100 and electronic device 200. This view also shows audio plug 102 inserted within locking sleeve 104. Over-molded strain relief 106 is coupled over the pre-mold 144, locking sleeve 104 and audio plug 102. The locking tab 128 is shown locked within a corresponding geometry of the housing socket 204.

Audio jack 220 is shown attached to a circuit board 240. The audio jack may be attached to an electronic circuit in any useful fashion; the jack is soldered to a printed circuit board in the example shown. Plug 102 is shown engaged with the audio jack 220.

The interface formed in accordance with the various embodiments can be implemented, for example, to secure the connector 100 to the housing 202 to meet predetermined pull forces and sealing. The axial pull force is established by the shear strength of the first hard-stop 206. This strength can be adjusted by modifying the width or depth of the first hard-stop 206. The side pull force is provided by the length of engagement between locking sleeve 104 and socket 204. Longer lengths of engagement reduce the tolerance of the angular position of plug 102 relative to jack 220. Damage to plug 102 and jack 220 is prevented by reducing this relative angular position. As for the sealing, the connector can be designed to meet, for example, a predetermined Ingress Protection rating, such as an IP54 rating for blowing rain.

Figure 10:
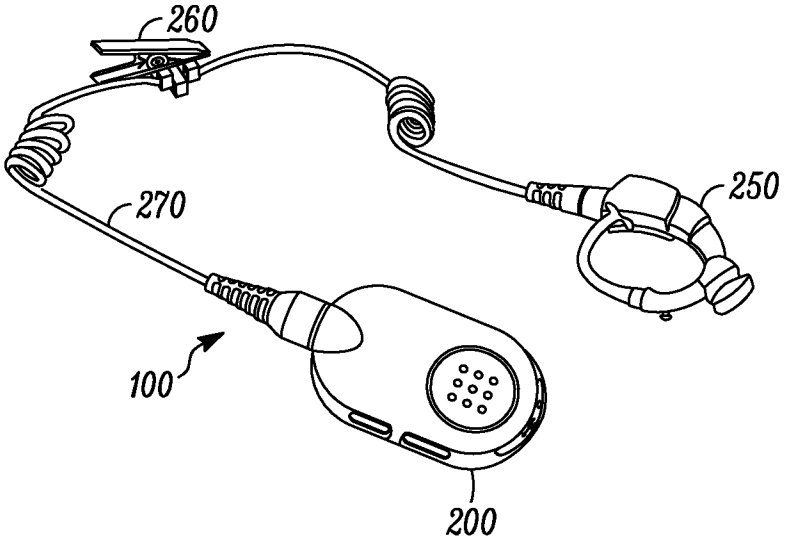
FIG. 10 shows the connector coupling the electronic device to an earpiece in accordance with the various embodiments.

The connector 100, formed in accordance with the various embodiments, is extremely useful in interfacing one portable accessory to another portable accessory. FIG. 10 shows the connector 100 coupling an electronic device comprising a pod having power, receive and transmit capability, volume control, and push to talk functionality to an earpiece having transmit and receive functionality. The connector 100 provides transmit, receive, detection, noise cancellation, and push to talk over a 6-pole audio plug to the earpiece. The pod may also be wirelessly coupled, for example using Bluetooth technology, to a radio (not shown) also worn by the user. The improved ruggedness provided by connector 100 is particularly advantageous for the management of interconnected portable electronic accessories, carried or worn by a user. A clip 260 may be attached on the wired connection, shown as cable 270, to facilitate placement of the accessories about the user's body. The ability to easily and quickly engage and disengage the pod from the earpiece 250 via connector 100 without damaging the interface is particularly beneficial to mission critical applications where several devices may need to be managed at one time by a single user.

While shown in FIG. 10 as an accessory-to-accessory interface, the connector 100 formed in accordance with the various embodiments may also interface a variety of different devices, such as covert earpiece, microphone, remote speaker mike, radio, etc.

Figure 11:
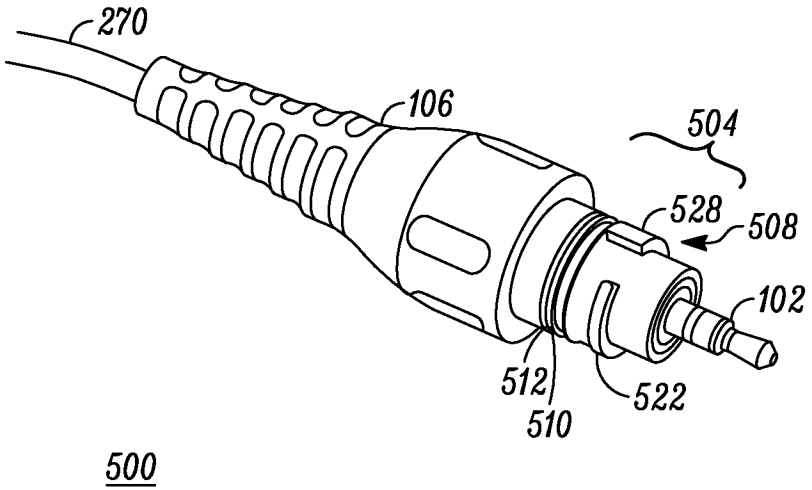
FIG. 11 shows a connector formed with a reverse locking sleeve in accordance with the various embodiments.

FIG. 11 shows a connector 500 formed in accordance with the various embodiments in which a locking sleeve 504 is formed of an integrally molded piece part having a locking pattern 508 and recess 510 within which o-ring 512 is retained. This locking pattern 508 comprises circular band 522 and locking tab 528 and operates in the same manner but with opposite rotation to the previously described locking pattern 108.

Additionally, the features of locking sleeve 104 and socket 204 can be reversed such that the socket with first hard-stop 206 is located on the cable/plug side, while the locking sleeve with features 112 (o-ring recess), 122 (circular band), 124, 126 (first and second ends of band), 128 (locking tab), 130 (gap) are formed on the housing side.

Accordingly, there has been provided a connector which can be applied to electronic products that requires robust, reliable engagement/disengagement. While particularly advantageous for portable public safety type devices, the connector interface may also be applied to stereos, personal music players, medical devices, audio recording equipment, laptops, video players, chargers, etc. Utilizing the locking sleeve formed in accordance with the various embodiments has eliminated the use of springs, screws and nuts. The use of the integrally molded locking sleeve further minimizes risk of corrosion and susceptibility to ESD.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. An interface mechanism for locking a connector to an electronic device, comprising:

a housing in the electronic device having a socket for receiving the connector, wherein a geometry within the socket of the housing comprises:

a partial circular band having a hard-stop formed on an interior surface of the socket; and a locking sleeve coupled between the connector and the electronic device, the locking sleeve comprising:

a cylindrical piece part having a locking pattern formed thereon and having a recess formed therein, the recess retaining an o-ring, the locking pattern formed of a circular band having first and second ends with a gap formed therebetween and a locking tab formed at either the first or second end, the locking pattern locking the connector to the electronic device over a predetermined range of rotation such that the gap of the locking sleeve aligns with the hard-stop, and the o-ring providing friction and sealing between the connector and electronic device.

2. A connector, comprising:

a plug;

a locking sleeve coupled to the plug, the locking sleeve formed of a cylindrical piece part having a locking pattern formed thereon, wherein the locking pattern locks the connector to a housing socket over a predetermined range of rotation such that a gap formed between first and second ends of the locking sleeve aligns with a hard-stop of a partial circular band formed on an interior surface of the housing socket; and a strain relief over-molded to the locking sleeve such that the locking pattern is exposed.

3. The connector of claim 2, wherein the locking sleeve prevents partial engagement/disengagement of the connector to and from the housing socket, and the locking sleeve interlocks to the housing socket.

4. The connector of claim 2, wherein the locking pattern formed on the locking sleeve is formed of a circular band having the gap between the first and second ends, and a locking tab formed at the first end of the circular band; and a recess located adjacent the circular band for retaining an o-ring.

5. The connector of claim 2, wherein the connector contains no springs.

6. The connector of claim 2, wherein the plug comprises an audio plug.

7. An interface mechanism for locking a connector to an electronic device, comprising:

the electronic device having a housing with a socket and a jack, wherein a geometry within the socket of the housing comprises a partial circular band having a first hard-stop formed on an interior surface of the socket;

a locking sleeve having a locking pattern and a recess;

an o-ring coupled within the recess of the locking sleeve; and a connector having a plug, the plug being insertably coupled to the jack and the socket via-the locking sleeve and the o-ring, wherein the locking pattern locks the connector to the socket over a predetermined range of rotation such that a gap formed between first and second ends of the locking sleeve aligns with the first hard-stop of the partial circular band, and friction from the o-ring on the locking sleeve prevents disengagement of the connector from the electronic device.

8. The interface mechanism of claim 7, wherein the locking pattern is integrally formed on an outer surface of the locking sleeve and the o-ring is retained on the locking sleeve by the recess formed in the outer surface of the locking sleeve.

9. The interface mechanism of claim 8, wherein the locking pattern on the locking sleeve locks to the geometry within the socket of the housing when the plug is inserted and turned into the socket of the housing over a predetermined range of rotation.

10. The interface mechanism of claim 9, wherein the locking pattern on the locking sleeve comprises:

a circular band having the gap between the first and second ends, and a locking tab formed at one end; and the recess within which the o-ring is retained.

11. The interface mechanism of claim 10, wherein the geometry within the socket of the housing comprises:

a surface which closes the recess within which the o-ring is seated; and the first hard-stop which aligns and inserts within the gap to provide full insertion and prevention of accidental extraction of the plug from the jack.

12. The interface mechanism of claim 11, wherein the first hard-stop within the socket prevents rotation beyond a predetermined angle of rotation set to any angle less than 360 degrees.

13. The interface mechanism of claim 11, wherein the geometry within the socket of the housing further comprises:

a second hard-stop about the jack, the plug being prevented from over insertion by the second hard-stop.

14. The interface mechanism of claim 11, wherein the plug locks to the jack by aligning marking symbols located on the connector and the electronic device, inserting the plug into the socket such that the first hard-stop slides within the gap, and turning the connector until the connector hits the first hard-stop indicating the plug is in a fully locked and engaged position, and the marking symbols being miss-aligned in the fully locked and engaged position.

15. The interface mechanism of claim 7, wherein the plug locks to the jack without the use of springs.

16. The interface mechanism of claim 7, wherein the jack is electrically coupled to a printed circuit board (pcb) within the housing of the electronic device.

17. The interface mechanism of claim 7, wherein the o-ring of the locking sleeve provides both protection from disengagement between the connector and the electronic device and a seal between the connector and the electronic device.

18. The interface mechanism of claim 7, wherein the connector interfaces one portable accessory to another portable accessory.

19. The interface mechanism of claim 7, wherein the plug comprises a circular off-the shelf component having electrical contacts which may rotate up to 360 degrees.

20. The interface mechanism of claim 7, wherein the plug comprises an audio plug, and the jack comprises an audio jack.

21. The interface mechanism of claim 7, wherein the electronic device comprises a pod, and the connector couples to the pod to provide transmit, receive, detection, noise cancelation, and push to talk over a 6-pole audio plug to an earpiece.

* * * * *